US006585369B1

(12) United States Patent
Sievert et al.

(10) Patent No.: US 6,585,369 B1
(45) Date of Patent: Jul. 1, 2003

(54) PREPARATIONS FOR INK-JET PRINTING ON COMMON HOUSEHOLD SURFACES

(75) Inventors: Otto K Sievert, Oceanside, CA (US); David C Tribolet, San Diego, CA (US); Stephan W. Emmenegger, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/125,305

(22) Filed: Apr. 17, 2002

(51) Int. Cl.[7] ..... B41J 2/01

(52) U.S. Cl. ..... 347/105; 347/101; 347/106; 347/107; 428/195

(58) Field of Search ..... 347/106, 102, 347/101, 105, 104, 100, 95, 96, 107, 1; 428/195, 98, 178, 103, 187, 184, 143, 364, 153; 106/31.13; 156/247

(56) References Cited

U.S. PATENT DOCUMENTS 5,141,599 A 8/1992 Jahn et al. ..... 162/137
5,631,071 A * 5/1997 Fukunishi et al. ..... 347/106
5,786,835 A * 7/1998 Ikeda et al. ..... 347/106
6,033,048 A * 3/2000 Nicoloff, Jr. et al. ..... 347/12
6,126,281 A * 10/2000 Shimoda et al. ..... 347/101
6,340,725 B1 1/2002 Wang et al. ..... 524/503

* cited by examiner

*Primary Examiner*—Raquel Yvette Gordon
*Assistant Examiner*—Manish Shah

(57) ABSTRACT

A method of printing on a household surface can comprise the steps of selecting a household surface for ink-jet printing; preparing the household surface by applying a pre-coat material to the household surface, wherein the pre-coat material can be configured to adhere to the household surface and accept a water-based ink-jet ink composition to a degree greater than the household surface in an uncoated condition; optionally, allowing the pre-coat material to substantially dry on the household surface; and ink-jet printing a color-containing ink-jet ink onto the pre-coat material after the pre-coat material has substantially dried on the household surface. Additionally, a method of reducing color to color bleed when ink-jet printing on a household surface can comprise the steps of providing a digital image having a first color pixel pattern and a second color pixel pattern; digitally masking the first color pixel pattern by removing pixels and causing the first color pixel pattern and the second color pixel pattern to be separated by a distance of at least one pixel, thereby forming a modified digital image; and ink-jet printing the modified digital image.

24 Claims, No Drawings

PREPARATIONS FOR INK-JET PRINTING ON COMMON HOUSEHOLD SURFACES

FIELD OF THE INVENTION

The present invention is drawn to ink-jet ink printing systems and methods for printing on typical household surfaces. More particularly, the present invention is drawn to the preparation of household or office surfaces for ink-jet printing such that good ink adhesion, lightfastness, and lack of bleed can be achieved.

BACKGROUND OF THE INVENTION

In recent years, computer printer technology has evolved to a point where very high-resolution images can be transferred to various types of media, including paper. One particular type of printing involves the placement of small drops of a fluid ink onto a media surface in response to a digital signal. Typically, the fluid ink is placed or jetted onto the surface without physical contact between the printing device and the surface. Within this general technique, the specific method that the ink-jet ink is deposited onto the printing surface varies from system to system, and can include continuous ink deposit and drop-on-demand ink deposit.

Essentially, continuous printing systems function as a stream of ink droplets are ejected and directed by a printer nozzle. The ink droplets are directed additionally with the assistance of an electrostatic charging device in close proximity to the nozzle. If the ink is not used on the desired printing surface, the ink is recycled for later use. With regard to drop-on-demand printing systems, the ink-jet inks are typically based upon water and glycols. Essentially, with these systems, ink droplets are propelled from a nozzle by heat or by a pressure wave such that all of the ink droplets ejected are used to form the printed image.

There are several reasons that ink-jet printing has become a popular way of recording images on various media substrates such as paper. Some of these reasons include low printer noise, capability of high-speed recording, and multicolor recording. Additionally, these advantages can be obtained at a relatively low price to consumers. However, though there has been great improvement in ink-jet printing, accompanying this improvement are increased demands by consumers in this area, e.g., higher speeds, higher resolution, full color image formation, increased stability, new applications, etc. As new ink-jet inks are developed, there have been several traditional characteristics to consider when evaluating the ink in conjunction with a printing surface or substrate. Such characteristics include edge acuity and optical density of the image on the surface, dry time of the ink on the substrate, adhesion to the substrate, lack of deviation of ink droplets, presence of all dots, resistance of the ink after drying to water and other solvents, long term storage stability, and long term reliability without corrosion or nozzle clogging. Though the above list of characteristics provides a worthy goal to achieve, there are difficulties associated with satisfying all of the above characteristics. Often, the inclusion of an ink component meant to satisfy one of the above characteristics can prevent another characteristic from being met. Thus, most commercial inks for use in ink-jet printers represent a compromise in an attempt to achieve at least an adequate response in meeting all of the above listed requirements.

In general, ink-jet inks are either dye- or pigment-based inks. Dye-based ink-jet inks generally use a soluble colorant that is usually water-based to turn the media a specific color. Alternatively, pigmented inks typically use a dispersed colorant to achieve color. In many cases, the line quality and accuracy of plots produced by pigment-based inks can be superior to that of dye-based inks. However, certain challenges exist with pigments because the colorant is present as a dispersion. With pigmented inks, solid particles are jetted with a vehicle and the solid particles adhere to the surface of the substrate. Once the water in the solution has evaporated, the particles will generally not redisperse, thereby producing a dried image.

Existing inking techniques, such as those used to print on the side of a semi-truck trailer, employ a solvent-based ink delivery system. Solvents evaporate more quickly in those systems than water in water-based ink-jet printer inks. This renders the substrate material properties to be less important. For example, with solvent-based systems, bleed and wicking are typically an order of magnitude less than in water-based ink-jet systems simply because the colorant does not have time to move much before the ink dries. One major disadvantage of these existing systems is that the solvents are undesirable to work with. For example, methyl-ethyl ketone (MEK) which is often used, is flammable, and in vapor form, is highly toxic.

SUMMARY OF THE INVENTION

It has been recognized that it would be desirable to provide systems and methods for preparing common household or office substrates such that water-based ink-jet printing can effectively occur thereon.

With this in mind, a method of printing on a household surface can comprise the steps of selecting a household surface for ink-jet printing; preparing the household surface by applying a pre-coat material to the household surface, wherein the pre-coat material can be configured to adhere to the household surface and accept a water-based ink-jet ink composition to a degree greater than the household surface in an uncoated condition; optionally, allowing the pre-coat material to substantially dry on the household surface; and ink-jet printing a color-containing ink-jet ink onto the pre-coat material after the pre-coat material has substantially dried on the household surface. The household surface is preferably rigid and substantially flat, though this is not strictly required. To illustrate, household surfaces that can be used including those selected from the group consisting of walls, flooring, ceilings, countertops, cabinets, appliances, fixtures, glass, and tables.

The coating material that can be used includes pre-coat materials selected from the group consisting of gelatin coatings, porous silica coatings, and polymeric coatings. The step of allowing the pre-coat material to substantially dry can be carried out at room temperature, or can be carried out using forced air and/or gentle heat at from 30° C. to 50° C. in one embodiment.

The step of ink-jet printing color-containing ink-jet ink onto the pre-coat material can be carried out using an ink-jet printer configured for printing on a fixed substrate. For example, an ink-jet printer having an ink-jet pen configured for jetting the pre-coat material onto a horizontal or vertical household surface can be used. In one embodiment, the pre-coat can be applied only to areas where color-containing ink-jet ink is to be applied. In another embodiment, the pre-coat can be applied to a more general printing area. The pre-coat can be applied in either case by an ink-jet printer, or by a more conventional coating method such as those selected from the group consisting of air knife coating, blade coating, gate roll coating, doctor blade coating, Meyer rod coating, roller coating, reverse roller coating, gravure coating, slot dye coating, curtain coating, brush coating, sprayer coating, and combinations thereof. Optionally, an overcoat can be applied to a household surface printed image to protect the image. The pre-coat and overcoat can preferably be substantially clear once dry, though this is not required, particularly with respect to the pre-coat.

In another aspect of the present invention, a method of reducing color to color bleed when ink-jet printing on a household surface can comprise the steps of providing a digital image having a first color pixel pattern and a second color pixel pattern; digitally masking the first color pixel pattern by removing pixels and causing the first color pixel pattern and the second color pixel pattern to be separated by at least one pixel, thereby forming a modified digital image; and ink-jet printing the modified digital image. In this embodiment, similar aspects as described above can be implemented such as the printing on household surfaces, and the use of similar pre-coat and overcoat compositions.

In a more detailed embodiment, digital masking can be carried out by the process of identifying a single pixel of interest; determining whether or not the single pixel of interest is of the fist color; determining whether or not adjacent to the single pixel of interest are of the first color; and changing any of the adjacent pixels to white that are not of the first color, if it is also determined that the single pixel of interest is of the first color.

The first color pixel pattern can be black or any color, as can the second color pixel pattern, provided the first color and the second color are different. Additionally, 3, 4, 5, 6, or more ink-jet pen systems can also be used with the present digital masking process. However, in one embodiment, the first color pixel pattern is black and the second color pixel pattern is one or more of cyan, magenta, and yellow. In a second embodiment, the first color pixel pattern is one or more of cyan, magenta, and yellow and the second color pixel pattern is black. Such masking is particularly useful when the first color ink and the second color ink are not compatible with one another for one reason or another, as is the case with certain ink-sets. In a multi-ink system, this embodiment may be repeated over multiple pixels. Additionally, the process can be repeated by focusing on a different color than the first color that is digitally masked.

DETAILED DESCRIPTION OF THE PREFERRED EMBODIMENT(S)

For the purposes of promoting an understanding of the principles of the invention, reference will now be made to the exemplary embodiments, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The singular forms "a," "an," and, "the" include plural referents unless the context clearly dictates otherwise. Thus, for example, reference to "an ink" includes reference to one or more of such inks.

As used herein, "sufficient amount" or "effective amount" refers to the minimal amount of a substance or agent, which is present in high enough quantities or concentration to achieve a desired effect. For example, an effective amount of an "ink vehicle" is the minimum amount required in order to create an ink that will meet functional performance and characteristic standards.

As used herein, "ink-jet ink," refers to an ink vehicle and a colorant combination where the colorant is suspended, dispersed, or solubilized in the ink vehicle to form the ink. Ink vehicles are well known in the art, and a wide variety of ink vehicles may be used with the ink composition of the present invention. Such ink vehicles may include a mixture of a variety of different agents, including without limitation, solvents, co-solvents, buffers, biocides, chelating agents, surface-active agents, water, and non-polymeric molecules. Colorants are also well known and can include dyes and/or pigments.

"Household surface" includes any rigid or semi-rigid, substantially flat surface found in typical office and home environments. Examples of such surfaces include flooring such as tile, linoleum, concrete, brick, hard wood, carpet, and the like; walls such as painted drywall, plaster, stucco, paneling, and the like; ceilings; countertops and tabletops such as laminates, tiles, woods, marble, solid surfaces including CORIAN® and granite, and the like; wood and pressboard cabinets; appliances; fixtures; glass; rigid plastics; metals; and alloys.

Ink-jet ink printers have been manufactured for various applications. Recently, some interest in the area printing on household surfaces has occurred. However, the difficulty of printing on such surfaces can be great, depending on the surface in question. For example, a wall or ceiling surface would provide different properties and challenges to an ink-jet printer and ink-jet ink than would a tile or linoleum floor surface. Likewise, a countertop surface or a table surface would also provide different challenges. Further, natural surfaces such as stone, tile, and wood react differently from one another when printed upon with aqueous ink-jet inks. Additionally, printing on artificial surfaces such as paints, stains, sheetrock, alloys, and plastic polymers provide additional printing challenges. Thus, to address this problem, one can sacrifice ink-jet ink performance on some substrates, create special ink-jet inks for specific applications, or solve this problem in another way.

Therefore, it has been recognized that normalizing such surfaces would provide great advantages to printing on various surfaces. For example, by coating glass, concrete, tile, or painted drywall with a substance that would adhere to these substrates, and also provide a good printing surface, such an ink-jet printing device would be rendered more useful. In further detail, this can be accomplished by coating the substrate such that an ink-jet printing design will be accepted by the substrate (and coating), reducing bleed and ink drip (particularly on vertical walls and ceilings) as well as providing a lightfast and colorfast image having good edge acuity.

With this in mind, it would be desirable to use such an automated printing mechanism to mark surfaces in or around a home or place of business. For example, a household surface printer might be used to print trim border around the perimeter of a room, to print a poster directly on a wall, to print custom images onto kitchen wall tiles, to print hopscotch squares directly on concrete, to print a particular holiday speckling temporarily on a carpet, to print a sign on a store window, or the like.

Certain properties of pre-coat materials may be desirable for use, if the goal of using the pre-coat material is to make the physical properties of the printing medium more homogenous. Such physical properties that can be considered include porosity, permeability, absorbancy, surface geometry and wetted surface tension properties, and the degree or tendency for wicking, due to capillary action or Van der Waals forces.

Thus, in accordance with an embodiment of the present invention, a method of printing on a household surface can comprise the steps of selecting a household surface for ink-jet printing; preparing the household surface by applying a pre-coat material to the household surface, wherein the pre-coat material can be configured to adhere to the household surface and accept a water-based ink-jet ink composition to a degree greater than the household surface in an uncoated condition; optionally, allowing the pre-coat material to substantially dry on the household surface; and ink-jet printing a color-containing ink-jet ink onto the pre-coat material after the pre-coat material has substantially dried on the household surface.

As common household surfaces have widely varying physical properties, consideration can be given to each before applying a given pre-coat material, as alluded to previously. For example, glass has very low porosity and absorbency, while flat latex paint is very porous and absorbent. Further, ink sits on top of semi-gloss latex paint, whereas ink soaks into untreated wood, untreated tile, and flat latex paint. Therefore, performance properties that can be considered for good results include: 1) the degree to which the ink is absorbed or sits on top of the material (this affects how vivid the printed image will be); 2) the degree of ink-to-ink bleed (this affects how sharp an edge can be printed, and how fine a resolution may attained); 3) dry time (the amount of time before the surface can be used normally, without smearing or otherwise damaging the print); 4) ink saturation limit (the maximum amount of ink that can be placed in any given region of the surface which also affects the how vivid an image may be printed); 5) permanence or durability of the image (how long will the printed image maintain adequate quality under typical usage of the surface on which the image is printed); and 6) clean-up (how easy is it to remove an image from the surface).

With these principles in mind, a pre-coat should adhere to the substrate adequately, and provide a single set of physical characteristics that will accept the printing inks. On glass, for example, a pre-coat should provide an absorbent layer that will capture the printing inks and prevent surface-tension pooling. As a second example, with flat latex paint, a pre-coat will tend to capture the ink, preventing it from being absorbed into the paint (absorption into the paint can cause ink bleeding and lower the vividness of the final image). Ideally, a surface that will accept printing inks through a manual or automatic pre-coat process will capture the ink drops so they do not bleed together with other ink drops, prevent over-absorption of ink into the surface, hold the ink so that it is reasonably difficult to smear or wipe off the surface, hold enough liquid such that the water (or other base carrier) that transports the colorant payload itself can evaporate or cure without over-saturation of the surface.

In some embodiments, a surface pre-coat comprising a swellable polymer such as gelatin, or a porous silica can be used to make the properties of various household printing substrates more uniform. Such a pre-coat applied manually by hand, such as by brush, roller, or aerosol spray, or can be applied automatically, such as with a printing mechanism, e.g., underprinting or overprinting. If applied using an ink-jet ink printer, an ink cartridge can be used that contains only the pre-coat material. Depending on the application and the household surface where printing is desired, different dry time or cure time may be required prior to addition of t e color-containing inks. In one embodiment, the composition can be of a liquid consistency and be clear in color, as is possible with the use of swellable or porous coatings used to manufacture photo media for ink-jet printers. However, such a coating could also be white in color if, for example, the coating contains a clay substance commonly used as sizing material in typical office paper a d coated paper production.

In other words, the pre-coat can be any coating that improves the ink-jet ink printing and/or adherence properties, such as a swellable or porous pre-coat composition similar to that found on typical photo-quality papers, as mentioned. Swellable and inorganic porous media papers are well known in the ink-jet ink arts. However, such coatings are typically used in the preparation of printing papers. For example, various coating coated papers (art paper, coat paper, cast-coat paper, etc.) have been prepared by coating a layer comprising a hydrophilic binder and an inorganic pigment on a paper substrate. Additionally, recording sheets have been prepared by coating an ink absorptive layer on paper or other supports, e.g., transparent or opaque plastic film supports. An example of such specialty media utilizes a swelling-type ink absorptive layer, e.g., gelatin. Likewise, inorganic pornus media has been used as well. There, a substantially inorganic media composition is prepared having surface voids and/or cavities capable of taking in the inkjet inks. As ink is printed on the porous media, the ink can fill the and the outermost surface can become dry to the touch in a more expedited manner. However, such media coatings are not known to have been used on common household surfaces. The use of such coatings can act, physically or chemically, to attract, hold, or protect the ink-jet ink. As many household surfaces are smooth, e.g., clay, tile, latex paints, and the like, creating a porous or swellable coating can enhance the ability of the common household surface to accept the inkjet ink composition.

Examples of pre-coat compositions that can be used to coat common household surfaces in accordance with the present invention can include those described in U.S. Pat. Nos. 5,141,599 and 6,340,725, each of which are incorporated herein by reference. Other coatings that can be used include silica coatings such as used in the prior art to coat paper, e.g., C6028A paper available from Hewlett-Packard Company; polymer coatings such as used in the prior art to coat paper, e.g., polyester media C3885A paper available from Hewlett-Packard Company and vinyl film media Jet Set 1000N paper available from Avery; and gelatin coatings such as used in the prior art to coat paper, e.g., C6034A paper available from Hewlett-Packard Company.

To illustrate a specific example of a coating material that can be used, and in accordance with U.S. Pat. No. 6,340,725, a coating composition can comprise a binder having an organic polymer which is substantially free of ammonium groups; a first cationic addition polymer consisting essentially of quaternary ammonium-containing mer units derived from addition monomer and ammonium-free mer units derived from addition monomer; and a second cationic addition polymer consisting essentially of secondary, tertiary, or both secondary and tertiary ammonium-containing mer units derived from addition monomer and ammonium-free mer units derived from addition monomer, wherein the binder constitutes from 20 to 90 percent by weight of the coating. Additionally, such a coating can further comprise a finely divided substantially water-insoluble filler particles which have a maximum dimension of less than 500 nanometers, are distributed throughout the binder, and constitute from 10 to 80 percent by weight of coating. Though the above coating examples have been provided, it is important to note that the invention is not a coating per se, but can include the use of a coating for printing on common household surfaces.

In another embodiment, where printing on a wall is desired, the latex or other paint product used to color a wall can be modified to optimize the surface for ink-jet ink printing. This can be done by formulating a latex paint so that properties typically present in papers are also present in the paint. For example, a latex paint having a relatively high cellulose content and/or a clay component similar to paper sizing materials can provide such an advantage.

In a further detailed aspect, after a surface has been inked with an ink-jet ink, it may be desirable to coat the resulting image for preservation. A post-coating, such as a lacquer, can be used to protect the ink from water, hand oil, sun damage, and the like. Such a post-coating can also act as a sealant, and to protect the print from periodic cleaning. In the event that the surface print is no longer desired, such a sealing post-coating can prevent the ink from bleeding through the application of paint, stain, or other known overcoat substance.

Examples of how to carry out embodiments of the present invention include the following. In one embodiment, an ink cartridge can be prepared that contains a clear pre-coat material that can be inserted into a pen of an ink-jet printer capable of printing on common household substrates. Other color-containing cartridges can be present in the printer as well. First, the pre-coat material can be printed onto a printing surface prior to application of the printing inks. The pre-coat material can comprise a material configured to accept the inkjet ink by being chemically reactive with an ink-composition, or can merely be absorptive to the ink-jet ink composition. For example, when the printing ink contacts the pre-coat material, an exothermic curing process can capture the printing colorants in a small casing. This casing can protect a colorant in the ink from being absorbed into the surface. Such an embodiment can provide some ability to stick to the surface, and provide some degree of ultraviolet protection.

In an alternative example, a paint can may be filled with a pre-coat material. Such a paint may be configured for brush or roller application to a household surface, or configured to be sprayed in an aerosol to a household surface. Such a pre-coat paint can contain clay compounds, for example, that create a paper-like coating on any surface. As the paint adheres to the surface, physical properties of typical office paper can be added to such a surface, i.e., absorbancy, porosity, etc.

The application of the coating composition can be conducted by using any of a number of other methods known in the art as well, including the use of an air knife coater, a blade coater, a gate roll coater, a doctor blade, a Meyer rod, a roller, a slot dye coater, a curtain coater, a reverse roller, a gravure coater, a brush applicator, a sprayer, and the like. Further, drying of such a coating may be effected by conventional means such as forced air, hot air, convection, microwave, or infrared heating, though open-air drying can also occur.

In addition to embodiments where a pre-coat is applied to normalize household surface properties, digital techniques can be utilized to reduce bleed on household surfaces. For example, a method of reducing color to color bleed when ink-jet printing on a household surface can comprise the steps of providing a digital image having a first color pixel pattern and a second color pixel pattern; digitally masking the first color pixel pattern by removing pixels and causing the first color pixel pattern and the second color pixel pattern to be separated by a distance of at least one pixel, thereby forming a modified digital image; and ink-jet printing the modified digital image. For example, such a digital image can be ink-jet printed on a household surface selected from the group consisting of walls, flooring, ceilings, countertops, cabinets, appliances, fixtures, and glass. The pre-coat or overcoat, as described previously, can also be used in conjunction with this digital masking process.

In one digital masking embodiment, the digital masking can be carried out by the process of identifying a single pixel of interest; determining whether or not the single pixel of interest is of the fist color; determining whether or not adjacent pixels to the single pixel of interest are of the first color; and digitally changing any of the adjacent pixels that are not of the first color to represent white, if it is also determined that the single pixel of interest is of the first color. This process can be carried out on all pixels using a computer processing chip, or can be carried out on a smaller group of pixels in a desired area, such as where greater image detail may be present. In this embodiment, the first color pixel pattern can be black and the second color pixel pattern can be one or more of cyan, magenta, and yellow. This is particularly useful when the black ink is reactive with one or more of the color inks. Alternatively, the first color pixel pattern can be one or more of cyan, magenta, and yellow and the second color pixel pattern can be black.

EXAMPLES

The following examples illustrate the preferred embodiments of the invention that are presently best known. However, other embodiments can be practiced that are also within the scope of the present invention.

Example 1

Preparation of Coating Composition

A coating composition is prepared similar to that described in U.S. Pat. No. 6,340,725, and comprises 1) a volatile aqueous liquid medium; and 2) a binder having a) a water-soluble film-forming organic polymer, b) a quaternary ammonium addition polymer, and c) a secondary amine functionalized acrylic polymer. Since the invention is not drawn any specific coating per se, this is only exemplary and any number of other coatings can be used with similar result.

Example 2

Coating of Common Household Substrates

The coating composition of Example 1 is applied to multiple areas of a latex painted drywall and ceramic tile sample using a Meyer rod. In each instance, a pool of coating material is placed at one end of a substrate surface, and the Meyer rod is drawn from one end to the other, leaving multiple uniformly thick coatings on the surfaces. This coating material is allowed to air dry for from 2 to 15 minutes, depending on the coating thickness applied and the substrate tested. Additionally, faster dry times are shown when using positive airflow and/or gentle heat. Various thicknesses are achieved, including thickness from 120 to 170 $\mu$m. Additionally, the coating is very clear, whether coated on the tile or painted drywall surface.

Example 3

Comparison Printing—Uncoated vs. Coated Household Substrates

The coated and uncoated household substrates (painted drywall and ceramic tile) are inked with an ink-jet printer configured for printing on flat rigid substrates. The resulting image quality is much higher on the coated substrates than on the uncoated (control) substrates. Specifically, the vibrancy of the images printed on the coated substrate is higher than on the uncoated substrate; the bleed and bloom present on the coated substrate is less than on the uncoated substrate; the printed images on the coated substrates dries to the touch in a finite amount of time (unlike the uncoated tile samples, which do not dry after days at ambient temperature and humidity); and the uniformity of the surface gloss and ink absorption is higher on the coated substrates.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

What is claimed is:

1. A method of printing a digital image on a household surface, comprising:

selecting a household surface for ink-jet printing;

preparing the household surface by ink-jetting a pre-coat material to the household surface, said pre-coat material being configured to adhere to the household surface and accept a water-based ink-jet ink composition to a degree greater than the household surface in an uncoated condition; and ink-jet printing a color-containing ink-jet ink onto the pre-coat material after the pre-coat material has substantially dried on the household surface.

2. A method as in claim 1 wherein the household surface is rigid and substantially flat, and wherein the household surface is selected from the group consisting of walls, flooring, ceilings, countertops, cabinets, appliances, fixtures, and glass.

3. A method as in claim 1 wherein the pre-coat material includes a component selected from the group consisting of gelatin, porous silica, polymeric material, and clay.

4. A method as in claim 3 wherein the pre-coat material includes polymeric material.

5. A method as in claim 1 further comprising the step allowing the pre-coat material to substantially dry prior to the ink-jet printing step.

6. A method as in claim 5 wherein the step of allowing the pre-coat material to substantially dry is carried using forced air and heat at from 30° C. to 50° C.

7. A method as in claim 1 wherein the step of ink-jet printing color-containing inkjet ink onto the pre-coat material is carried out using an ink-jet printer configured for printing on a fixed substrate.

8. A method as in claim 7 wherein the pre-coat is applied by an ink-jet printer, said ink-jet printer having an ink-jet pen configured for jetting the pre-coat material onto the household surface.

9. A method as in claim 8 wherein the pre-coat is applied only to areas where color-containing ink-jet ink is to be applied.

10. A method as in claim 1 further comprising the step of overcoating the color-containing ink-jet ink once printed on the pre-coat.

11. A method as in claim 1 wherein the pre-coat material is clear when dry.

12. A method as in claim 1 wherein multiple colors are digitally processed and printed from an ink-jet printer on the pre-coat material to form a multi-color image.

13. A method as in claim 12 wherein digitally processed data is digitally asked prior to printing.

14. A method of reducing color to color bleed when ink-jet printing on a household surface, comprising:

providing a digital image having a first color pixel pattern and a second color pixel pattern;

digitally masking the first color pixel pattern by removing pixels and causing the first color pixel pattern and the second color pixel pattern to be separated by a distance of at least one pixel, thereby forming a modified digital image; and ink-jet printing the modified digital image on the household surface.

15. A method as in claim 14 wherein the digital image is printed on a household surface selected from the group consisting of walls, flooring, ceilings, countertops, cabinets, appliances, fixtures, and glass.

16. A method as in claim 15 wherein the household surface is pre-coated with a material configured to adhere to the household surface and accept an ink-jet ink composition to a degree greater than the household surface in an uncoated condition.

17. A method as in claim 14 wherein the digital masking occurs by the process of:

identifying a single pixel of interest;

determining whether or not the single pixel of interest is of the fist color;

determining whether or not adjacent pixels to the single pixel of interest are of the first color; and digitally changing any of the adjacent pixels that are not of the first color to represent white if it is also determined that the single pixel of interest is of the first color.

18. A method as in claim 14 wherein the first color pixel pattern is black and the second color pixel pattern is one or more of cyan, magenta, and yellow.

19. A method as in claim 14 wherein the first color pixel pattern is one or more of cyan, magenta, and yellow and the second color pixel pattern is black.

20. A method of printing a digital image on a household surface, comprising:

selecting a household surface for ink-jet printing;

preparing the household surface by applying a pre-coat material to the household surface, said pre-coat material being configured to adhere to the household surface and accept a water-based ink-jet ink composition to a degree greater than the household surface in an uncoated condition;

drying the pre-coat material on the household surface using forced air and heat at from 30° C. to 50° C.; and ink-jet printing a color-containing ink-jet ink onto the pre-coat material after the pre-coat material has substantially dried on the household surface.

21. A method as in claim 20 wherein the household surface is rigid and substantially flat, and wherein the household surface is selected from the group consisting of walls, flooring, ceilings, countertops, cabinets, appliances, fixtures, and glass.

22. A method as in claim 20 wherein the pre-coat material is applied by an ink-jet printer, and is applied only to areas where color-containing ink-jet ink is to be applied.

23. A method as in claim 20 wherein the pre-coat is applied by a method selected from the group consisting of air knife coating, blade coating, gate roll coating, doctor blade coating, Meyer rod coating, roller coating, reverse roller coating, gravure coating, slot dye coating, curtain coating, brush coating, sprayer coating, and combinations thereof.

24. A method as in claim 20 further comprising the step of overcoating the color-containing ink-jet ink once printed on the pre-coat.

* * * * *

UNITED STATES PATENT AND TRADEMARK OFFICE

CERTIFICATE OF CORRECTION

PATENT NO. : 6,585,369 B1
DATED : July 1, 2003
INVENTOR(S) : Sievert et al.

It is certified that error appears in the above-identified patent and that said Letters Patent is hereby corrected as shown below:

Column 9,
Line 63, delete “asked” and insert therefor -- masked --.

Signed and Sealed this

Twentieth Day of April, 2004

JON W. DUDAS
*Acting Director of the United States Patent and Trademark Office*